US006152399A

United States Patent [19]

Chang et al.

[11] Patent Number: 6,152,399

[45] **Date of Patent: *Nov. 28, 2000**

[54] FIBER ENTRY WHIP REDUCTION APPARATUS AND METHOD THEREFOR

[75] Inventors: Chester Hann Huei Chang; Kenneth William Roberts, both of Wilmington; Johnnie Edward Watson, Hampstead, all of N.C.

[73] Assignee: Corning Incorporated, Corning, N.Y.

[ * ] Notice: This patent is subject to a terminal disclaimer.

[21] Appl. No.: 09/340,485

[22] Filed: Jun. 30, 1999

Related U.S. Application Data

[63] Continuation of application No. 09/290,472, Apr. 12, 1999, Pat. No. 5,964,431.

[60] Provisional application No. 60/083,045, Apr. 24, 1998.

[51] Int. Cl.[7] ..... B65H 23/04; B65H 71/00; B65H 54/00; B65H 57/00

[52] U.S. Cl. ..... 242/615.3; 226/89; 242/157 R; 242/615.2; 242/899; 242/920

[58] Field of Search ..... 242/615.2, 615.3, 242/920, 157 R, 153, 474.5, 474.9, 475.7, 548, 899; 226/89, 90

[56] References Cited

U.S. PATENT DOCUMENTS

| | | | |
|---|---|---|---|
| 1,744,739 | 1/1930 | Blout . | |
| 3,182,921 | 5/1965 | Nelson . | |
| 3,661,335 | 5/1972 | Stefaniszyn | 242/474.9 |
| 3,945,580 | 3/1976 | Veyrassat . | |
| 4,039,107 | 8/1977 | Boley . | |
| 4,138,069 | 2/1979 | Bonzo et al. | 242/474.5 |
| 4,164,331 | 8/1979 | Henrich | 242/157 R X |
| 4,989,799 | 2/1991 | Nakai et al. | 242/157 R X |
| 5,558,287 | 9/1996 | Darsey et al. . | |
| 5,964,431 | 10/1999 | Chang et al. | 242/615.3 |

OTHER PUBLICATIONS

T. Matilla, "Reliable High Speed Proof Testing of Optical Fiber", Feb. 1998, Wire Journal International, pp. 123–129.

*Primary Examiner*—Michael R. Mansen
*Attorney, Agent, or Firm*—Timothy R. Krogh; David L. Berdan

[57] ABSTRACT

An apparatus and method for reducing or preventing fiber entry whip as the loose end of a fiber being wound on a spool enters a fiber winding device. A fiber winding device comprises a spool winder entrance, a winding spool and a fiber whip shield substantially surrounding the winding spool. A fiber entry whip reducer positioned in front of the fiber winding device comprises at least one pulley and a guide channel including a straight entry section and a curved section leading to the fiber winding device. The guide channel is formed and positioned such that the loose end of the fiber is maintained against the guide channel by centrifugal force imparted onto the fiber by the curvature of the channel and forward motion of the fiber produced by the rotating spool, thereby producing a trajectory such that the loose end of the fiber enters the fiber winding device and is maintained against the whip shield. By maintaining the free end of the fiber against the guide channel during fiber entry, whip damage to the fiber on the spool due to impact of the fiber end during its entry is substantially reduced or completely eliminated.

20 Claims, 8 Drawing Sheets

FIBER ENTRY WHIP REDUCTION APPARATUS AND METHOD THEREFOR

CROSS-REFERENCE TO RELATED APPLICATIONS

This application is a continuation of U.S. application Ser. No. 09/290,472, filed Apr. 12, 1999 now U.S. Pat. No. 5,964,431, which claims the benefit of U.S. Provisional Application Ser. No. 60/083,045, filed Apr. 24, 1998.

BACKGROUND OF THE INVENTION

1. Field of the Invention

This invention is directed to a fiber entry whip reduction apparatus and a method for preventing damage to fiber, such as an optical fiber, being wound onto a rotating spool caused by the whipping action of a loose end of the fiber acting on the fiber already wound on the spool.

2. Technical Background

In the optical fiber or plastic filament manufacturing industries, long lengths of fiber or filament are wound at high speeds upon machine rotated take-up spools for shipping and handling. As the fiber is wound on the spool, the fiber is laid down onto the spool in successive layers. In the optical fiber industry, fiber winding takes place at two general locations; at the draw tower where the fiber is originally drawn, and at an off-line screening station where the fiber is strength tested. At each of these locations, the fiber can be wound at high speeds, for example, over 20 meters per second, and is maintained at relatively high tension. The apparatus for winding the fiber usually contains a relatively intricate feed assembly that includes several pulleys which guide the fiber. The pulleys facilitate proper tension on the fiber as it is wound onto the spool, while the feed apparatus facilitates uniform fiber winding onto the spool.

During winding events, the fiber is susceptible to breakage due to forces applied by the winding machine. When such fiber breaks occur, the loose end of the fiber tends to whip around at high speed due to the rapid rotation rate of the take-up spool. The uncontrolled loose fiber end can impact fiber already wound onto the spool and cause significant and irreversible damage to as many as 15 to 16 layers of the fiber. In the optical fiber industry, this can result in damage of up to 1500 meters of fiber. The break event is unpredictable, and following such a break the machine must be brought to an immediate stop to prevent whipping damage to the fiber. However, because the break is unpredictable and the spool cannot be stopped instantaneously, there is inevitably a period of time during which the spool will continue to rotate and the fiber end will be drawn toward the spool where it can whip against the fiber already wound onto the spool, thus causing damage to the fiber.

In order to prevent fiber whip damage to the fiber already wound on the spool, apparatus and methods have been developed to prevent the loose end of the fiber from striking fiber already wound on the spool. U.S. Pat. No. 5,558,287, issued to Darsey et al. discloses an apparatus and method for preventing whip damage to fiber wound onto a spool. Darsey et al. disclose a spool onto which fiber is wound, positioned above a series of brushes having bristles protruding away from the spool. As the loose end of a broken fiber flails around, it is captured by the bristles and is prevented from striking fiber on the spool. However, this type of whip protection has at least one disadvantage. The spool system requires a large and open area about which the fiber can whip relatively unobstructed. Usually, fiber winding areas are not so unobstructed.

In most cases manufacturers have guards or shields mounted for safety reasons. In many winding applications, guards on the winding machines consist of a square box around the spool, or a deflector plate mounted parallel to the spool axis of rotation. The purpose of these guards is to prevent whipping fiber from harming an operator after a break. However, these types of guards actually increase the probability that the fiber tip will strike the fiber pack. Any type of angled surface on the guard permits the free end of the fiber to strike an edge thereof, causing the fiber to wrap around the edge and rebound against the spool.

In commonly assigned U.S. patent application Ser. No. 60/050,489; the entirety of which is hereby incorporated by reference, a whip shield is disclosed. The whip shield comprises a series of arcuate portions that form a non-circular shield around the spool. As the loose end of a fiber enters the spool area, centrifugal force generated by the rotating spool maintains the loose fiber end against the shield, thereby preventing whipping damage.

However, there must be an opening in the guard to allow the fiber to be wound onto the spool. Any type of entrance opening will produce an angled edge that in turn produces the above described whip action in the fiber end.

SUMMARY OF THE INVENTION

The present invention is directed to a novel apparatus and method for reducing or preventing fiber entry whip of an optical fiber being wound on a spool by overcoming one or more of the above-described shortcomings associated with fiber winding. "Optical Fiber", as used herein, includes both glass and plastic optical fiber.

A principal advantage of the present invention is the provision of an arrangement which substantially obviates one or more of the limitations and shortcomings associated with arrangements known in the art. By maintaining the free end of the fiber against the smooth surface of a guide channel that directs the path of the fiber as it enters the spool winding area, the fiber is controlled and maintained as it is directed against a whip shield that substantially surrounds the spool during spool rotation. Moreover, it eliminates all other paths from the feed assembly to the spool, removing the possibility of a direct impact by the fiber end. Accordingly, whip damage to the fiber on the spool can be substantially reduced or completely prevented with such an arrangement.

Additional features and advantages of the invention will be set forth in the description which follows, and in part will be apparent from the description, or may be learned by practice of the invention. These and other advantages of the invention will be realized and attained by the process particularly pointed out in the written description and claims hereof as well as the appended drawings.

To achieve these and other advantages and in accordance with the purpose of the invention, as embodied and broadly described, the invention is directed to an apparatus for reducing fiber whip damage to optical fiber wound onto a fiber winding spool. The apparatus includes a fiber winding device having a whip shield that substantially surrounds the spool, and a fiber entry whip reducer positioned upstream of the fiber winding device. The fiber entry whip reducer includes a guide channel and at least one exit pulley at least partially residing within the guide channel. The guide channel is positioned with respect to the whip shield such that a loose end of the optical fiber is directed against the whip shield as the optical fiber leaves the guide channel.

Another aspect of the invention relates to an apparatus for reducing fiber whip damage to fiber wound on a spool. The apparatus comprises at least one entrance pulley and a fiber winding device including a spool winder entrance, a winding spool and a fiber whip shield substantially surrounding the winding spool. A fiber entry whip reducer is positioned between a fiber entry pulley and the fiber winding device. The whip reducer includes at least one exit pulley and a guide channel. One embodiment of the guide channel preferably has a straight entry section and a curved section leading to the fiber winding device. The straight section of the channel calms the flailing of the fiber as it enters the fiber entry whip reducer.

The guide channel is positioned such that a loose end of the fiber will be maintained against the curved section of the guide channel by centrifugal force. The guide channel produces a fiber trajectory such that the loose end of the fiber will enter the fiber winding device and be maintained against the fiber whip shield as the spool rotates. The fiber entry whip reducer may optionally include a feed pulley and an entrance pulley which guide the fiber into the fiber whip reducer.

The fiber whip reducer preferably includes a housing formed by two plates. The guide channel is formed when the two plates are in a closed position. In one embodiment, a ramp that leads to the fiber-winding device is defined in the curved section of the guide channel. The apparatus according to the present invention may also include a removable barrier shield that substantially encloses the fiber entry whip reducer and isolates the fiber winding device from the feed assembly.

Another aspect of the present invention relates to a method for reducing fiber whip damage to fiber wound on a spool. . The fiber is fed through a fiber entry whip reducer comprising at least one exit pulley and a guide channel comprising a straight entry section and a curved section leading to a fiberwinding device. The method includes the further step of capturing a loose end of the fiber against the guide channel by centrifugal force imparted onto the fiber by the curvature of the guide channel and forward motion imparted by the winding device. The method includes the further step of maintaining the loose end of the fiber against the guide channel thereby producing a fiber trajectory such that the loose end of the fiber will enter the fiber winding device, move directly to the whip shield that substantially surrounds the spool, and be maintained against the fiber whip shield as the spool rotates.

It is to be understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and together with the specification serve to explain the principles of the invention.

DETAILED DESCRIPTION OF THE INVENTION

Figure 1:
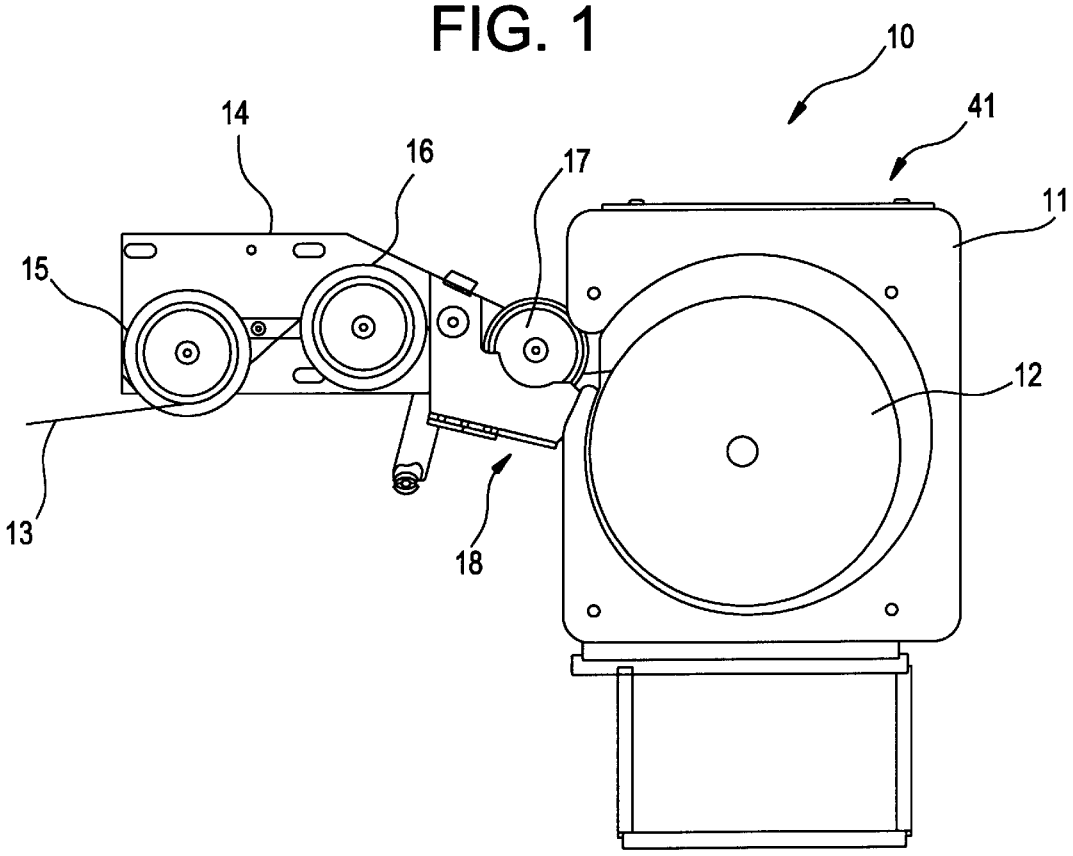
FIG. 1 is a side elevation view of a first preferred embodiment of a fiber entry whip reduction apparatus according to the present invention.

Reference will now be made in detail to the present preferred embodiments of the invention, examples of which are illustrated in the accompanying drawings. Whenever possible, the same reference numbers will be used throughout the drawings to refer to the same or like parts. A first preferred embodiment of the fiber entry whip reduction apparatus device of the present invention is shown in FIG. 1, and is designated generally throughout by reference numeral 10.

FIG. 1 illustrates a first preferred embodiment of a fiber entry whip reduction apparatus 10 in accordance with the present invention for reducing fiber entry whip such as during the manufacture and storage of optical fiber used in telecommunication applications. As illustrated in FIG. 1, fiber entry whip reduction apparatus 10 includes a fiber winding device 41 having a whip shield 11 for substantially surrounding a spool 12 on which fiber is wound. Spool 12 is rotated by a motor (not shown). Fiber 13 enters fiber winding device 41 through pulley mount 14. In the illustrated embodiment, pulley mount 14 includes a feed pulley 16 that guides fiber 13 into a fiber entry whip reducer 18. Pulley mount 14 may optionally include, but is not limited too, a second pulley, such as entrance pulley 15 to help guide and maintain tension on fiber 13.

Fiber 13 is wound onto spool 12 at a relatively high rate of speed, e.g., draw speeds of about 30 m/s or higher and screening speeds of about 22 m/s or higher. Fiber 13 is also maintained under a relatively high tension to ensure proper winding onto spool 12. If the fiber is an optical fiber, it may be supplied directly from any known type drawing apparatus (not shown) or a known type of screening device (not shown).

Ideally, if spool 12 is suspended in free space, there would be no need for any shield or guard around the spool. However, as illustrated in FIG. 1, in order to prevent injuries to operators standing near the spool if the fiber breaks, a whip shield 11 is mounted around spool 12. In practice, if the fiber 13 breaks, the loose fiber end will be maintained against the inner surface 27 of shield 11. However, the entrance to fiber winding device 41 presents an obstacle as shield 11 creates several edges on which the fiber can catch. If left unaddressed, any edge of shield 11 could cause the fiber end or tail to wrap itself around the edge and whip back on the fiber pack as the loose end of the fiber enters the spool area.

Another whip hazard is caused by the feed assembly. In run mode, the fiber 13 curves around every pulley 15, 16 and 17. When a break occurs, however, fiber stiffness drives the fiber from the curved shape towards a straighter shape. This leads to an uncontrolled swinging motion as the fiber comes off the pulleys and the fiber end is pulled towards the spool 12. Depending upon how the fiber slips off the pulleys once tension is lost (after the fiber breaks), the fiber end could move in a direct path towards the fiber on the spool 12. In the configuration shown in FIG. 1, but without the fiber entry whip reducer 18, the fiber end has been observed to move directly towards and impact the fiber on spool 12. The fiber end has also been seen to bounce off the axle of pulley 17, then strike the fiber on spool 12.

Fiber entry whip reducer 18 is designed to reduce or eliminate the whip action of the loose end of fiber 13 as it enters the spool area. It does this by restricting the fiber end to a path towards the whip shield 11 which keeps the fiber end away from fiber on the spool 12 and yields a gentle landing on the inner surface 27 the whip shield 11 such that the end does not bounce off the whip shield 11 inner surface 27. Fiber entry whip reducer 18 includes exit pulley 17 from which fiber 13 exits the whip reducer 18 and enters the spooling area to be wound onto spool 12.

Figure 2:
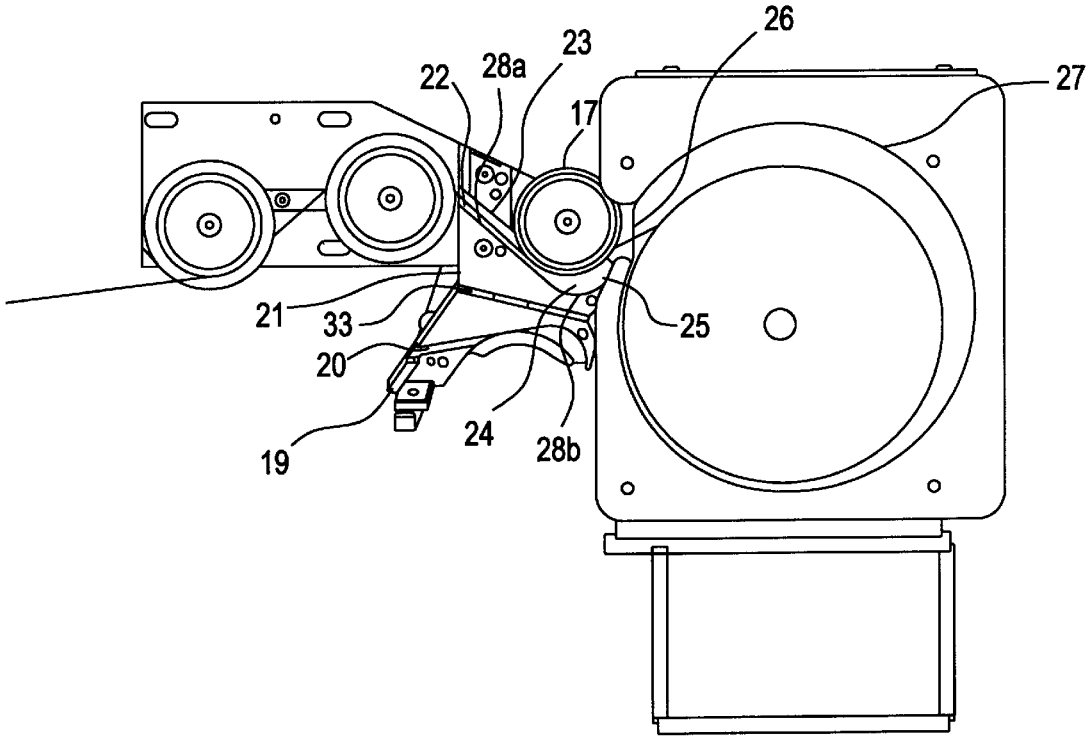
FIG. 2 is a side elevation view of the fiber entry whip reduction apparatus of FIG. 1 illustrating the guide channel arrangement according to the present invention.
Figure 3A:
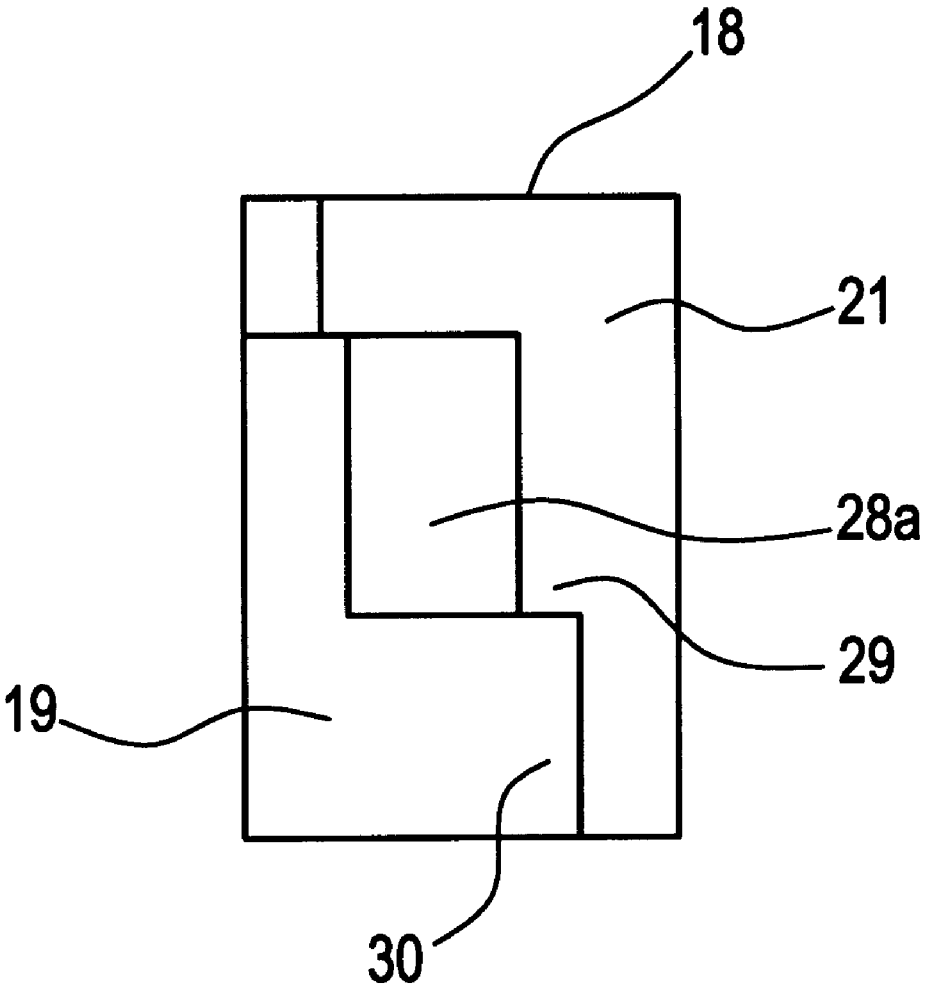
FIG. 3A is a front elevation view of the straight section of the guide channel of the fiber entry whip reduction apparatus shown in FIG. 1.
Figure 3B:
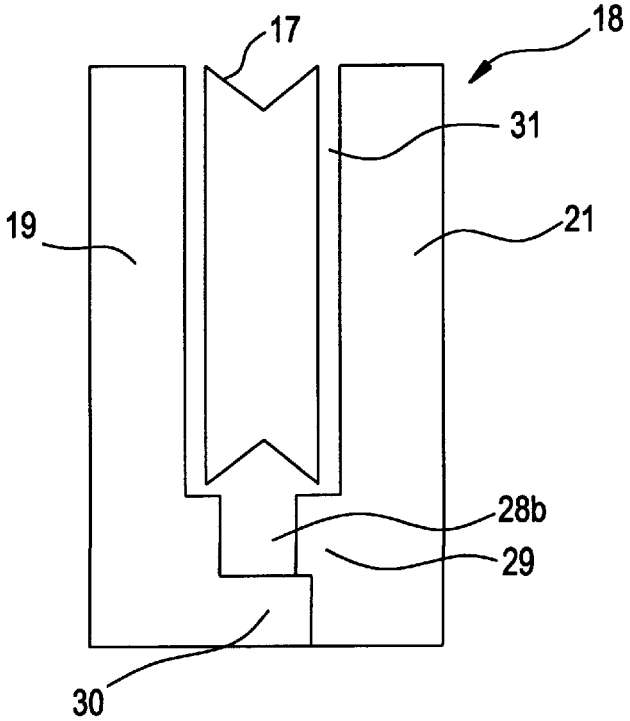
FIG. 3B is a front elevation view of the curved section of the guide channel of the fiber entry whip reduction apparatus shown in FIG. 1.

FIG. 2 illustrates an optional aspect of a preferred embodiment of the fiber entry whip reducer 18 according to the present invention. Fiber entry whip reducer 18 comprises a face plate 19 and a back plate 21 that are hinged together by any known type of hinging mechanism 33. This arrangement permits easy access to exit pulley 17 for re-threading of fiber 13 after a fiber break. Grooves 20 and 22 are formed in opposing face plate 19 and back plate 21 respectively. As illustrated in FIG. 3, when plates 19 and 21 are closed, a first guide channel portion 28*a* (FIG. 3A) is formed in a substantially straight section of the fiber entry whip reducer 18 and a second guide channel portion 28*b* (FIG. 3B) is formed in the curved section (FIG. 3B). Although first guide channel portion 28*a* is illustrated as having a distinct length, in practice, the channel may be of different lengths, provided it is of a sufficient length to adequately calm the fiber prior to the fiber reaching a curved section 24.

As shown in FIG. 2, guide channel portions 28*a* and 28*b*, formed by opposing grooves 20 and 22, consist of a straight entry section 23 leading to a highly concave curved section 24. Curved section 24 leads to ramp 25 which in turn leads to spool winder entrance 26. A principal function of straight entry section 23 is to calm the whipping action of the free fiber end as it enters fiber entry whip reducer 18. As the loose end of a fiber is pulled through curved section 24 by rotation of spool 12, centrifugal force maintains the fiber end against the lower curved surface of curved section 24 and ramp 25. Thus, the loose end of fiber 13 will take the shape of ramp 25 which defines a trajectory for the loose end of the fiber as it exits fiber entry whip reducer 18 and enters the spool winder at spool winder entrance 26. In other words, ramp 25 is substantially parallel to inner surface 27 of whip shield 11 thereby producing a fiber trajectory such that the loose end of fiber 13 is smoothly directed onto the inner surface 27 of whip shield 11 thus reducing or preventing fiber whip damage. Accordingly, concave curved section 24 and ramp 25, together, help reduce or prevent fiber whipping by guiding the fiber end into the spool winder entrance 26.

As illustrated in FIG. 3B, guide channel portion 28*b* is formed below exit pulley 17 and back plate 21 is provided with a lip 29. When back plate 21 and face plate 19 are in a closed position as shown in FIGS. 3A and 3B, lip 29 overlaps edge 30 of face plate 19, forming guide channels 28*a* and 28*b*, respectively. The overlap insures the fiber doesn't slip out of the entry guard between face plate 19 and back plate 21. Because the flange diameter of exit pulley 17 is preferably only slightly smaller than the diameter of the recess 31 (FIG. 3B) in which exit pulley 17 is positioned, fiber 13 is prevented from escaping from guide channel 28.

Figure 4:
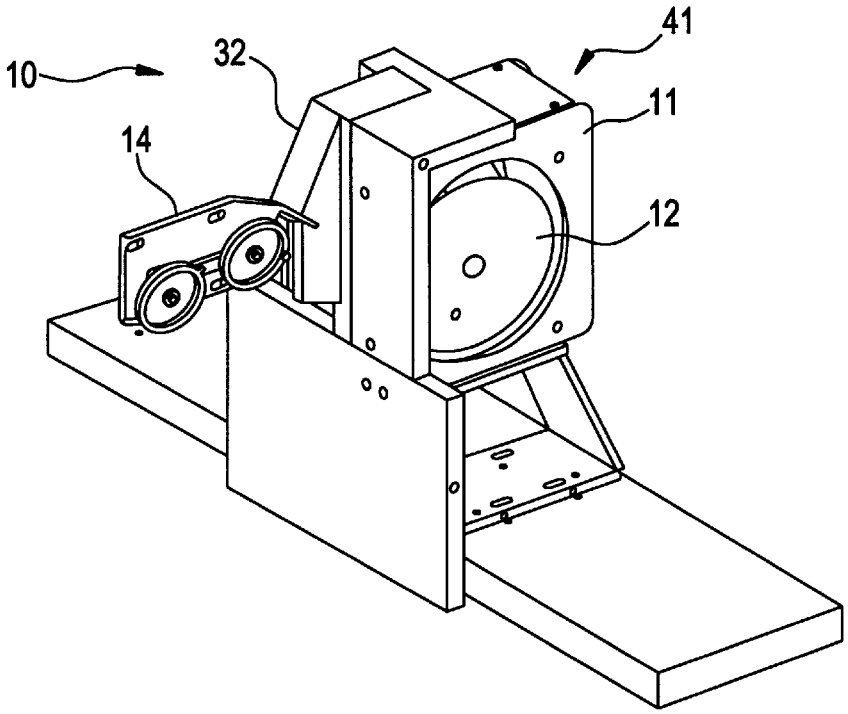
FIG. 4 is a perspective view of the fiber entry whip reduction apparatus of FIG. 1 more clearly illustrating the barrier shield and whip shield.

As illustrated in FIG. 4, the fiber entry whip reduction apparatus 10 may also include a barrier shield 32. Barrier shield 32 is removable and is positioned around fiber entry whip reducer 18. Barrier shield 32 prevents the loose fiber end or pieces of broken fiber generated as the end flails around the feed assembly from being thrown directly into fiber winding device 41.

As embodied herein, the invention is also directed to a method for reducing or preventing damage to a fiber being wound on a spool comprising several steps. As illustrated in FIG. 2, fiber entry whip reducer 18 described above in accordance with the present invention controls the trajectory of the fiber end after a break while the spool is still rotating. Fiber 13 is threaded between feed pulley 15 and entrance pulley 16 on pulley mount 14. These pulleys provide both fiber guiding and tensioning functions. Fiber 13 is also threaded through exit pulley 17, then into and around spool 12. Face plate 19 is then closed and the spool is rotated to take up or wind the fiber. As face plate 19 is closed, guide channels 28*a* and 28*b* are formed. Fiber passes through the straight entry section 23 of fiber entry whip reducer 18, beneath and partially around exit pulley 17 and through spool winder entrance 26 to spool 12.

If a fiber break occurs during winding, the loose end of fiber 13 will be drawn into the straight entry section 23. Due to centrifugal force, the loose fiber will be forced to and maintained against the curved section 24 of whip reducer 18. Due to the highly curved nature of guide channel 28*b*, and the positioning of ramp 25, a fiber trajectory path is defined such that the loose end of the fiber will be guided into fiber winding device 41 towards the whip shield inner surface 27 where it will be maintained against the inner surface 27 of fiber whip shield 11 by centrifugal force.

Preferably, spool 12 is substantially surrounded by a non-circular whip shield 11. Shield 11 preferably has a smooth and substantially continuous inner surface 27 facing the spool. This smooth curved surface helps to prevent rebound of the fiber back against the fiber pack.

Figure 5:
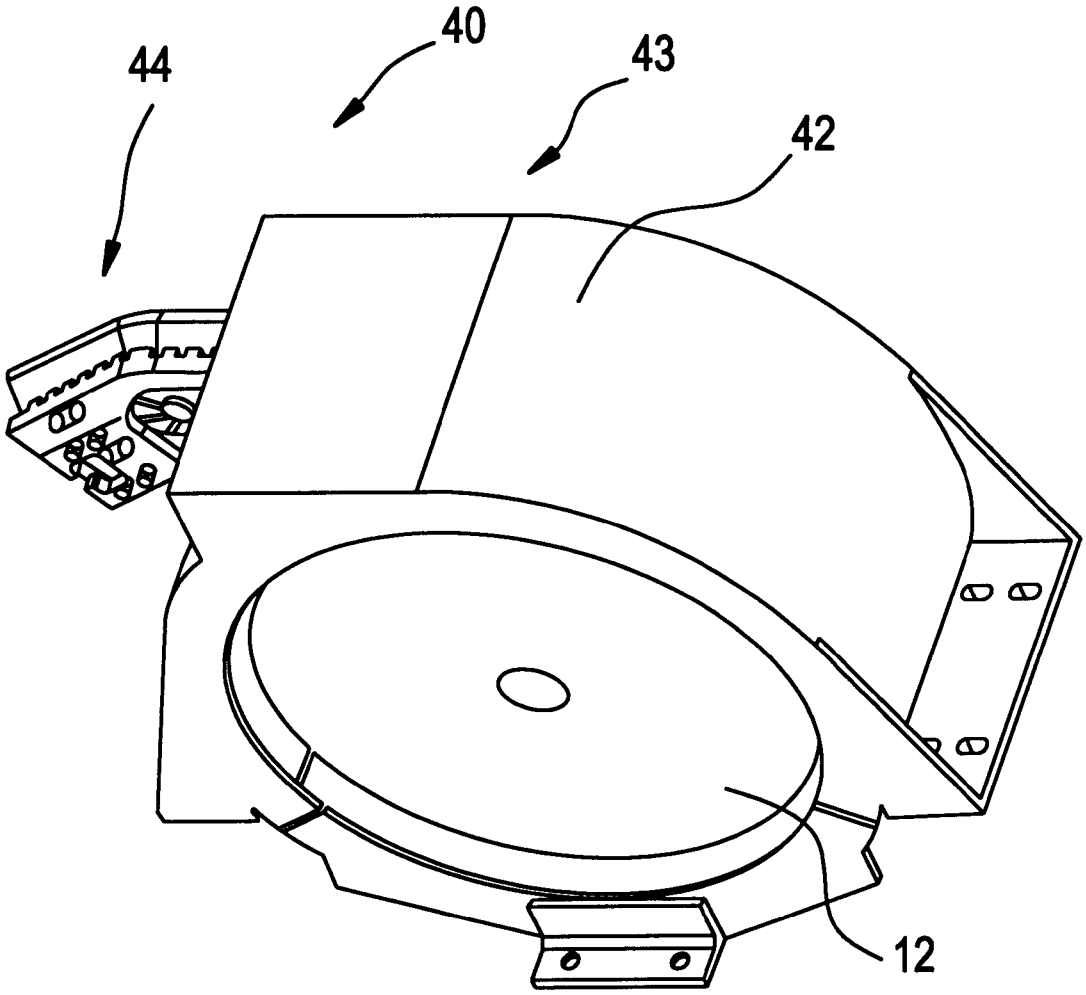
FIG. 5 is a perspective view of a second preferred embodiment of a fiber entry whip reduction apparatus according to the present invention.

FIG. 5 illustrates a second preferred embodiment of a fiber entry whip reduction apparatus 40 in accordance with the present invention for reducing fiber entry whip such as during the manufacture and storage of optical fiber used in telecommunication applications. As shown in FIG. 5, fiber winding device 43 includes a whip shield 42 substantially surrounding a spool 12 upon which optical fiber 13 is wound. Fiber entry whip reduction apparatus 40 further includes a preferred embodiment of a fiber entry whip reducer 44 positioned upstream of spool 12 and whip shield 42.

Figure 6:
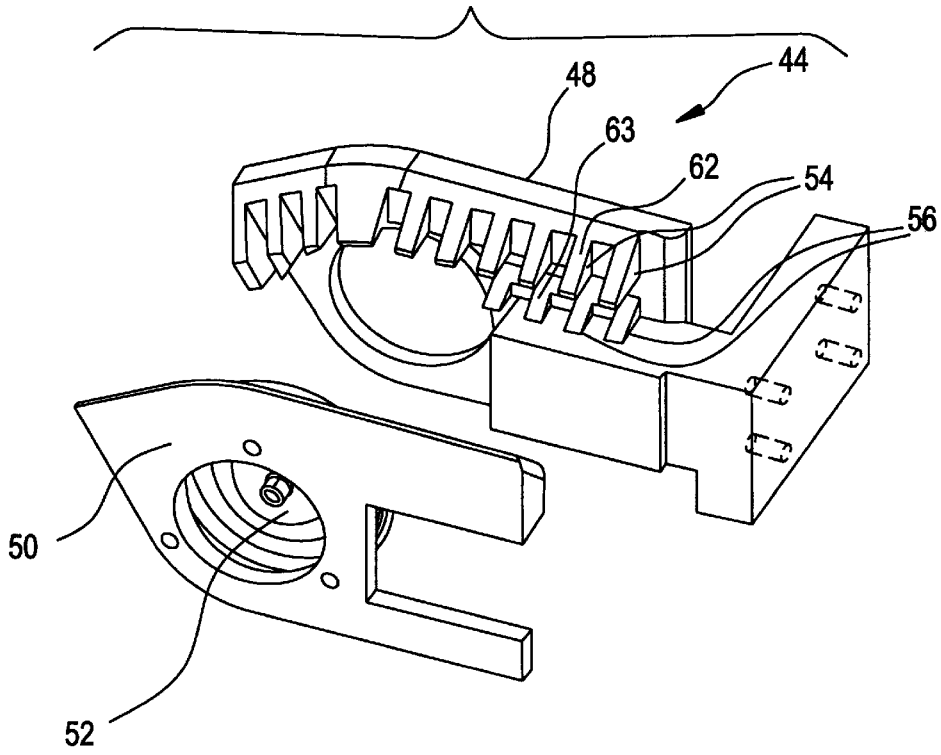
FIG. 6 is a perspective view of the preferred fiber entry whip reducer of the fiber entry whip reduction apparatus of FIG. 5 showing the inner surface of the face plate.
Figure 7:
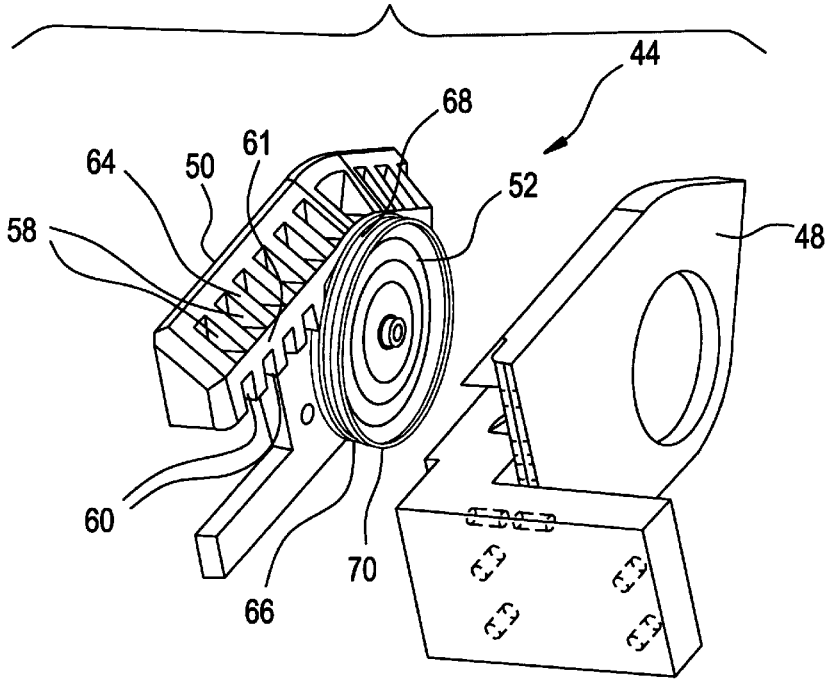
FIG. 7 is a perspective view of the fiber entry whip reducer depicted in FIG. 6 showing the inner surface of the back plate.

A more preferred embodiment of fiber entry whip reducer 44 is shown more clearly in the perspective views depicted in FIGS. 6 and 7. Fiber entry whip reducer 44 of fiber entry whip reduction apparatus 40 is shown open and includes a face plate 48 and back plate 50. Mounted between opposed face plate 48 and back plate 50 is an exit pulley 52. Formed along the inner surface of face plate 48 are a plurality of teeth 54 and 56. Guide teeth 54 are positioned above and preferably aligned laterally with respect to bottom teeth 56.

The structure and function of teeth 54 and 56 is more clearly described with reference to back plate 50 illustrated in FIG. 7. As shown in FIG. 7, back plate 50 includes a plurality of slots arranged in two distinct rows. Guide slots 58 and bottom slots 60 are preferably separated by a planar abutment 61, and are sized and shaped to receive guide teeth 54 and bottom teeth 56, respectively, when fiber entry whip reducer 44 is moved to the closed position by an actuator mechanism (not shown). As will be described in greater detail below, bottom teeth 56 and corresponding bottom slots 60 are not incorporated downstream of exit pulley 52, in the preferred fiber entry whip reducer 44 depicted in FIGS. 6 and 7.

As shown in FIG. 6, guide teeth 54 and bottom teeth 56 include inwardly sloping surfaces 62 and 63, respectively. Back plate 50 also includes an inwardly sloping surface 64 which terminates at abutment 61. Exit pulley 52 is preferably mounted to back plate 50 such that at least a portion of abutment 61 extends over lip 66 of exit pulley 52. In such an arrangement, sloped surface 64 serves as a guiding surface for optical fiber 13 during re-threading operations. In particular, when optical fiber 13 is lowered onto exit pulley 52, an improperly aligned optical fiber 13 will be deflected into the concave region 68 of exit pulley 52 by sloped surface 64. It will be understood by those skilled in the art that face plate 48 is movable and can be opened such that sloped surfaces 62 of guide teeth 54 extend over lip 70 of exit pulley 52 so that sloped surfaces 62 can perform the above-described function from the other side of pulley 52. In this way, misthreading of fiber 13 within fiber entry whip reducer 44 is prevented.

Figure 8B:
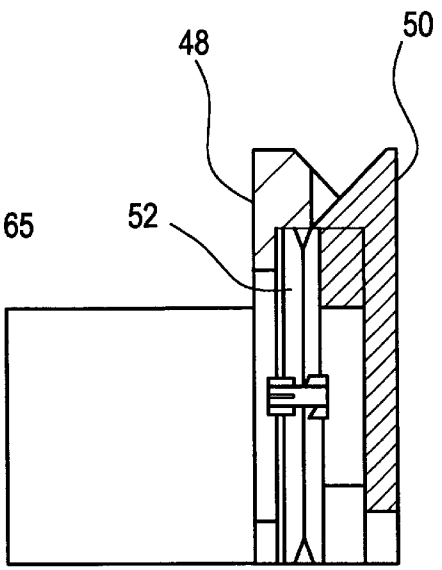
FIG. 8B is a cross-sectional view of the fiber entry whip reducer taken along line 8B—8B of FIG. 8.
Figure 8:
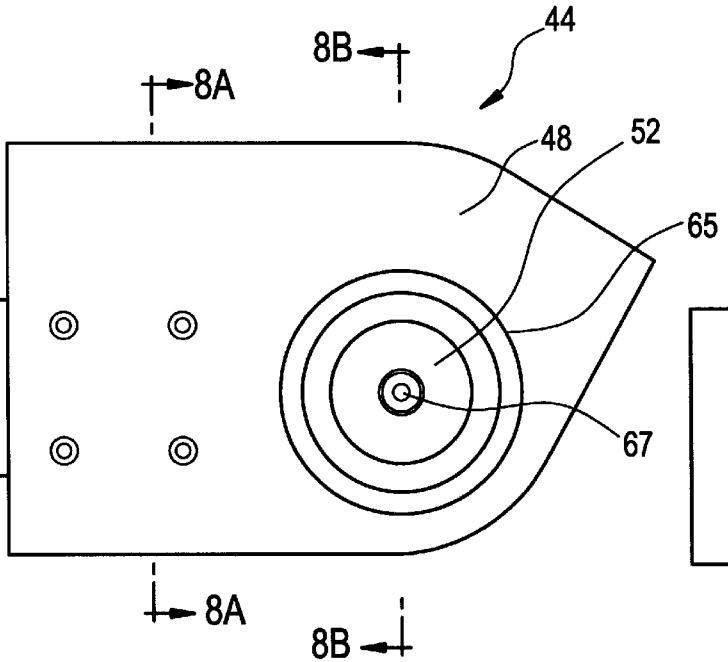
FIG. 8 is a side elevation view of the fiber entry whip reducer of FIG. 6.
Figure 8A:
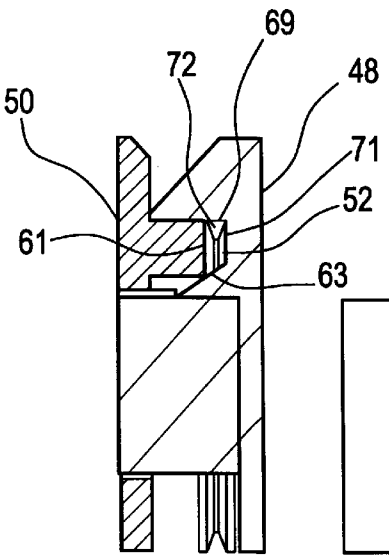
FIG. 8A is a cross-sectional view of the fiber entry whip reducer shown taken along line 8A—8A of FIG. 8.

When fiber entry whip reducer 44 is closed as shown in FIG. 8, exit pulley 52 is partially received in opening 65 defined in face plate 48. Although not necessary, opening 65 facilitates maximum closure of fiber entry whip reducer 44 as it allows fastener 67 to protrude through face plate 48. Referring now to FIG. 8A, face plate 48 and back plate 50 are shown in the fully closed position, such that guide teeth 54 and bottom teeth 56 are received within guide slot 58 and bottom slot 60, respectively. When closed, bottom surfaces 69 of guide teeth 54, inner surface 71 of face plate 48, sloped surfaces 63 of bottom teeth 56, and abutment 61 define a smooth passageway 72 bounded by smooth surfaces for guiding a free end of optical fiber 13 through fiber entry whip reducer 44 over and onto exit pulley 52 and into spool winder entrance 74 (FIG. 9) following a fiber break. Moreover, exit pulley 52 is preferably positioned with respect to face plate 48 and back plate 50, such that the fiber carrying portion of exit pulley 52 is preferably centered laterally within passageway 72.

Figure 9:
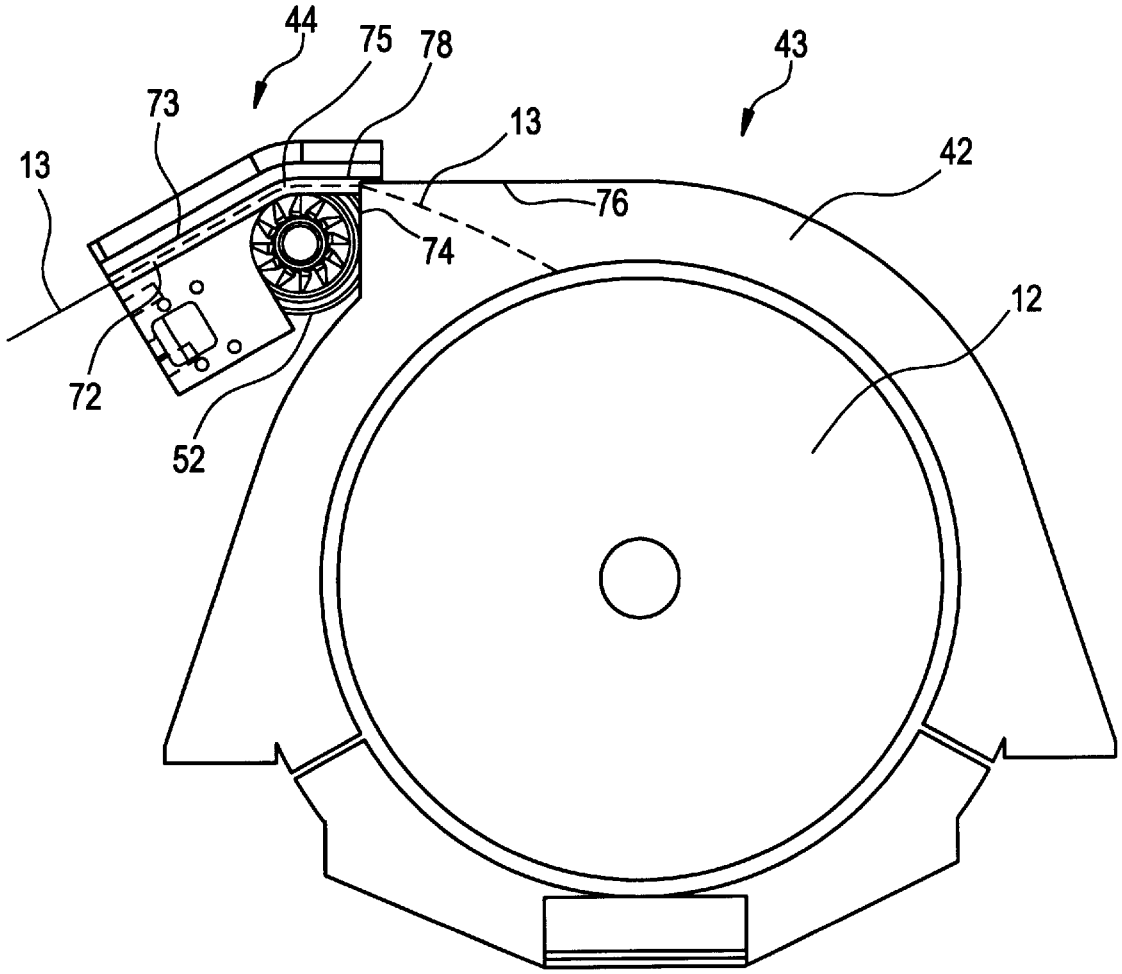
FIG. 9 is a side elevation view of the fiber entry whip reduction apparatus of FIG. 5 showing the fiber path through the fiber entry whip reducer.

In operation, as shown in FIG. 9, optical fiber 13 passes through passageway 72 onto exit pulley 52 which in turn directs optical fiber 13 into spool winding entrance 74. As depicted in FIG. 9, optical fiber 13 passes over exit pulley 52 rather than under the exit pulley as described with respect to the first preferred embodiment of the present invention. Due to this arrangement of exit pulley 52 and fiber 13 within fiber entry whip reducer 44, optical fiber 13 is directed downwardly at an angle onto spool 12 as fiber 13 exits fiber entry whip reducer 44. Accordingly, as shown in FIG. 8B, face plate 48 does not include bottom teeth 63 or other protrusions which would otherwise obstruct the path of fiber 13 as it enters fiber winding device 43. In the event of a fiber break, passageway 72 calms optical fiber 13 as it enters fiber entry whip reducer 44. As the free end of optical fiber 13 moves closer to passageway 72, the amplitude of fiber whipping is accordingly reduced. In addition, the stiffness of optical fiber 13 tends to force the free end of optical fiber 13 against upper surface 73 of passageway of 72 as optical fiber 13 enters fiber entry whip reducer 44. This inherent property of the fiber 13 together with centrifugal force acting on fiber 13 as a result of the fiber 13 passing through curved section 75 and the continued rotation of spool 12 will tend to maintain fiber 13 against the upper surface 73 of passageway 72. The free end of fiber 13 will be guided by curved section 75 of passageway 72 to straight section 78 at the downstream end of passageway 72. Because upper surface 73 of passageway 72 is substantially co-planar with inner surface 76 of whip shield 42 along straight section 78 of passageway 72, and because the downstream end of fiber entry whip reducer 44 is in close proximity with or preferably abutting whip shield 42, continuous guidance and control is provided to optical fiber 13 as the free end of optical fiber 13 passes through fiber entry whip reducer 44 into spool winder entrance 74. More specifically, free end of optical fiber 13 will travel directly along upper surface 73 along straight section 78 onto inner surface 76 of whip shield 42. Although centrifugal force no longer acts on optical fiber 13 after the fiber end passes curved section 75, the short length of optical fiber 13 between spool 12 and the free end of the fiber, together with the inherent fiber stiffness will tend to maintain optical fiber 13 in contact with upper surface 73 of straight section 78 of passageway 72.

Following a fiber break, and as briefly described above, fiber entry whip reducer 44 can be opened to allow re-threading of optical fiber 13 onto exit pulley 52. Fiber entry whip reducer 44 can be opened so that sloped surfaces 62 and 64 guide optical fiber 13 onto exit pulley 52 and into passageway 72. It will be recognized by those skilled in the art that following an optical fiber break during winding operations, fragments of fiber and coating material can be deposited along the surfaces defining passageway 72 within fiber entry whip reducer 44. An advantage of preferred fiber entry whip reducer 44 of this embodiment is the self-cleaning function provided by bottom teeth 56. The sloped surfaces 63 of bottom teeth 56 enable loose debris to slide off the bottom teeth 56 when fiber entry whip reducer 44 is opened, thus keeping passageway 72 clear for fiber passage. Thus, down-time due to cleaning operations is reduced with the use of preferred fiber entry whip reducer 44.

It will be understood by those skilled in the art that fiber entry whip reduction apparatus 40 may optionally include a barrier shield similar to barrier shield 32 described with reference to the first preferred embodiment of the present invention. Such a barrier shield (not shown) will substantially cover fiber entry whip reducer 44 and opening 74 to fiber winding device 43, thereby further limiting the paths of entry into fiber winding device 43. In addition, it is to be understood that the specific structure of fiber entry whip reducer 44 is not to be limited to the embodiments shown in the accompanying drawing figures. More specifically, it is to be understood that straight section 78 of passageway 72 may be curved in other embodiments of the present invention. Similarly, inner surface 76 of whip shield 42 may also be curved at spool winding entrance 74. In this way, centrifugal force can continue to be applied after the free end of optical fiber 13 passes exit pulley 52, and thus the curved section 75 of passageway 72. Continued centrifugal force will further assist in maintaining optical fiber 13 against the upper surfaces once the free end of optical fiber 13 passes exit pulley 52. In addition, it is envisioned that back plate 50 can be fitted with one or more teeth or other protrusions for engaging with bottom teeth 56 of face plate 48. Such an interlocking feature would actively clean fiber debris from the bottom surfaces of passageway 72 when fiber entry whip reducer 44 is opened for re-threading or other operations.

It will be apparent to those skilled in the art that various modifications and variations can be made to the present invention without departing from the spirit or scope of the invention. Thus, it is intended that the present invention cover the modifications and variations of this invention provided they come within the scope of the appended claims and their equivalents.

We claim:

1. An apparatus for reducing fiber whip damage to optical fiber wound on a fiber winding spool comprising:

a fiber entry whip reducer positioned upstream of the fiber winding spool, said fiber entry whip reducer defining a guide channel through which the optical fiber passes, and being positioned with respect to the fiber winding spool such that a loose end of the optical fiber is directed away from the fiber winding spool.

2. The apparatus of claim 1 further comprising a whip shield constructed and arranged to substantially surround the fiber winding spool.

3. The apparatus of claim 2 wherein said fiber entry whip reducer directs the loose end of the fiber against the whip shield as the loose end of the fiber exits the whip reducer and enters through an opening in the whip shield.

4. The apparatus of claim 2, wherein the guide channel is positioned with respect to said whip shield such that it guides the loose end of the fiber along a path which mitigates against fiber whipping.

5. The apparatus of claim 1 wherein said fiber entry whip reducer comprises at least one exit pulley.

6. The apparatus of claim 5 wherein the at least one exit pulley resides at least partially within the guide channel.

7. The apparatus of claim 1 wherein the guide channel includes a substantially straight section and a curved section, said curved section for altering the trajectory of the loose end of the optical fiber prior to the loose end of the optical fiber exiting said fiber entry whip reducer.

8. The apparatus of claim 1, further comprising a removable barrier shield substantially surrounding said fiber entry whip reducer.

9. A method for reducing fiber whip damage to fiber wound on a spool said method comprising the steps of:

feeding optical fiber from an optical fiber source through a fiber entry whip reducer and onto the spool, said fiber entry whip reducer comprising a guide channel;

restricting movement of the optical fiber, including a loose end thereof, within said guide channel; and directing the loose end of the optical fiber away from the spool as the loose end of the optical fiber passes through the guide channel.

10. The method of claim 9 wherein said directing step comprises the step of altering the trajectory of the loose end of the optical fiber with said guide channel.

11. The method of claim 9 wherein the spool is substantially surrounded by a whip shield, and wherein said directing step comprises guiding the loose end of the optical fiber against said whip shield.

12. The method of claim 11 wherein said directing step further comprises guiding the loose end of the optical fiber against an inner surface of said whip shield.

13. The method of claim 11 further comprising substantially maintaining the loose end of the optical fiber against the guide channel and guiding said loose end of the optical fiber along said guide channel to produce a fiber trajectory such that the loose end of the optical fiber is guided onto the whip shield.

14. The method of claim 9 wherein said restricting step comprises the step of capturing the loose end of the optical fiber against the guide channel with the assistance of centrifugal force imparted to the optical fiber by rotation of the spool.

15. The method as claimed in claim 9 wherein said guide channel includes a curved section and a substantially straight section, said restricting step comprising the step of controlling the loose end of the optical fiber with the substantially straight section of the guide channel to calm fiber whipping.

16. The method as claimed in claim 15 wherein said restricting step further comprising the step of guiding the loose end of the optical fiber along the curved section to produce a fiber trajectory such that the loose end of the fiber is directed away from the spool.

17. An apparatus for reducing optical fiber whip following an optical fiber break upstream of a fiber winding spool, said apparatus comprising:

a fiber entry whip reducer positioned upstream of the fiber winding spool, said fiber entry whip reducer defining a guide channel, an end of the guide channel positioned with respect to the fiber winding spool such that a loose end of the optical fiber passing through the guide channel is directed away from the fiber winding spool as the loose end of the fiber exits said fiber entry whip reducer.

18. The apparatus of claim 17 wherein said fiber entry whip reducer comprises a back plate and a face plate, one of said back plate and said face plate being moveable with respect to the other of said back plate or said face plate.

19. The apparatus of claim 18 wherein said back plate includes a plurality of slots and wherein said face plate includes an opposing plurality of teeth, the plurality of slots and the plurality of teeth being constructed and arranged to interlock to define said guide channel.

20. The apparatus of claim 17 wherein said fiber entry whip reducer further comprises at least one pulley positioned at least partially within said guide channel.

* * * * *